United States Patent [19]

Calvert et al.

[11] 4,237,673

[45] Dec. 9, 1980

[54] MACHINE FOR LOADING CONTAINER SLEEVES THROUGH THEIR OPEN ENDS

[75] Inventors: Rodney K. Calvert, Dunwoody; Charles R. Landrum, Doraville, both of Ga.

[73] Assignee: The Mead Corporation, Dayton, Ohio

[21] Appl. No.: 25,367

[22] Filed: Mar. 30, 1979

[51] Int. Cl.[3] ..... B65B 21/02

[52] U.S. Cl. ..... 53/48; 53/251

[58] Field of Search ..... 53/48, 251, 154, 543, 53/237, 148, 236, 381 R

[56] References Cited

U.S. PATENT DOCUMENTS

| | | | |
|---|---|---|---|
| 2,756,553 | 7/1956 | Ferguson et al. | 53/48 |
| 2,974,454 | 3/1961 | André et al. | 53/48 X |
| 3,037,431 | 6/1962 | McGihon | 53/48 X |
| 3,300,947 | 1/1967 | Fahrenbach | 53/48 |
| 3,332,199 | 7/1967 | Wong | 53/48 X |
| 3,778,959 | 12/1973 | Langen et al. | 53/251 X |

*Primary Examiner*—Horace M. Culver
*Attorney, Agent, or Firm*—Rodgers & Rodgers

[57] ABSTRACT

A packaging machine for loading a group of primary packages such as bottles through the open ends of an open ended sleeve container (C) includes a fixed horizontally disposed base plate (50) over which a plurality of transverse parallel spaced apart metering bars (51) are movable in spaced relation to the base plate so that an open ended sleeve carton disposed in the spaces between the metering bars is slidable over the base plate together with fixed guide means (86–89) (93–96) disposed alongside the base plate for receiving primary packages from an infeed conveyor, the fixed guide means being disposed at an acute angle to the path of movement of the metering bars so that primary packages are supplied by the fixed guide means into the spaces between the metering bars and thence into the open ends of the sleeve type containers disposed therebetween.

9 Claims, 6 Drawing Figures

50
63
51
71
C7
70
F1
F3
F2
F4
W3
W1
W2
W4
108
105
C6
C5
107
104
95a
93a
C4
106
100
3
5
80
83
84
85
81
90
91
92
C3
P
86
87
C2
96
95
93
94
89
88
C1
51b
51a
54
55
P1
P2
P3
P4
P5

MACHINE FOR LOADING CONTAINER SLEEVES THROUGH THEIR OPEN ENDS

TECHNICAL FIELD

This invention relates to apparatus for loading groups of primary packages such as bottles through the open ends of sleeve type containers.

BACKGROUND ART

U.S. Pat. No. 3,778,959 discloses a container end loading machine which comprises several conveyors one of which is arranged to support spaced apart metering bars and another of which is arranged to supply open ended sleeve compartments into a position of co-operation with the metering bars for effecting loading through one end of a series of open ended containers.

DISCLOSURE OF THE INVENTION

According to this invention in one form, a packaging machine is provided which includes a fixed horizontal base plate over which a plurality of spaced apart metering bars are movable with open ended sleeve type containers disposed therebetween together with guide means disposed at an acute angle to the path of movement of the metering bars so that primary packages such as bottles supplied to the guide means on each side of the machine by infeed conveyors are forced by line pressure into the path of movement of the end portions of the metering bars which effect a metering operation whereby a predetermined number of primary packages are entrapped between spaced apart metering bars at both ends thereof so that continued movement of the metering bars relative to the fixed guides forces the group of articles into each end of the open ended sleeves. According to a feature of the invention, the base plate is slotted for slidably receiving support posts on which the metering bars are mounted and which in turn are interconnected with endless means the working reach of which is disposed below the fixed plate for imparting movement to the metering bars.

BEST MODE FOR CARRYING OUT THE INVENTION

Figure 1:
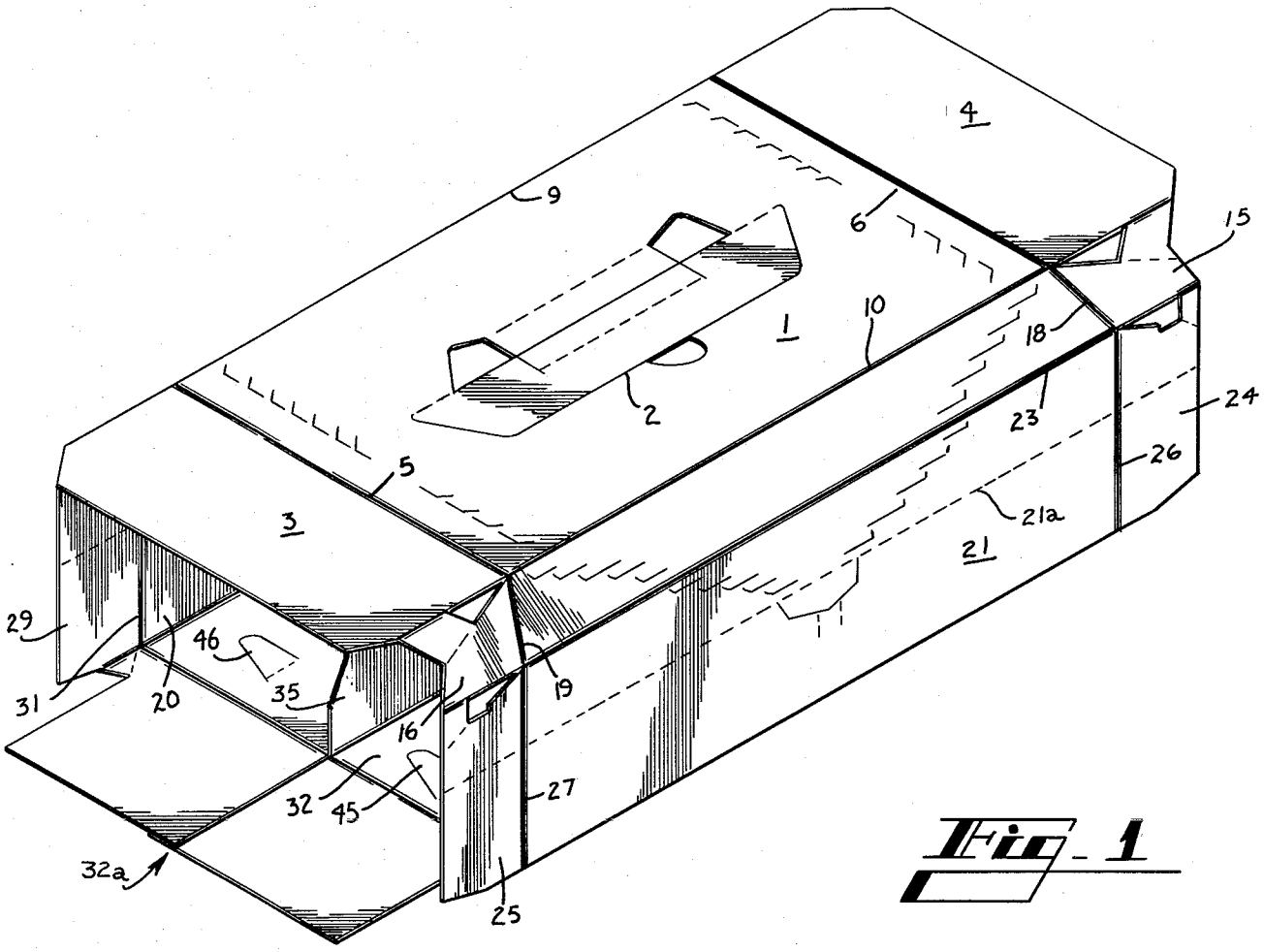
FIG. 1 is an isometric view of an open ended sleeve type carton of the type to which the machine of this invention is particularly adapted.
Figure 1A:
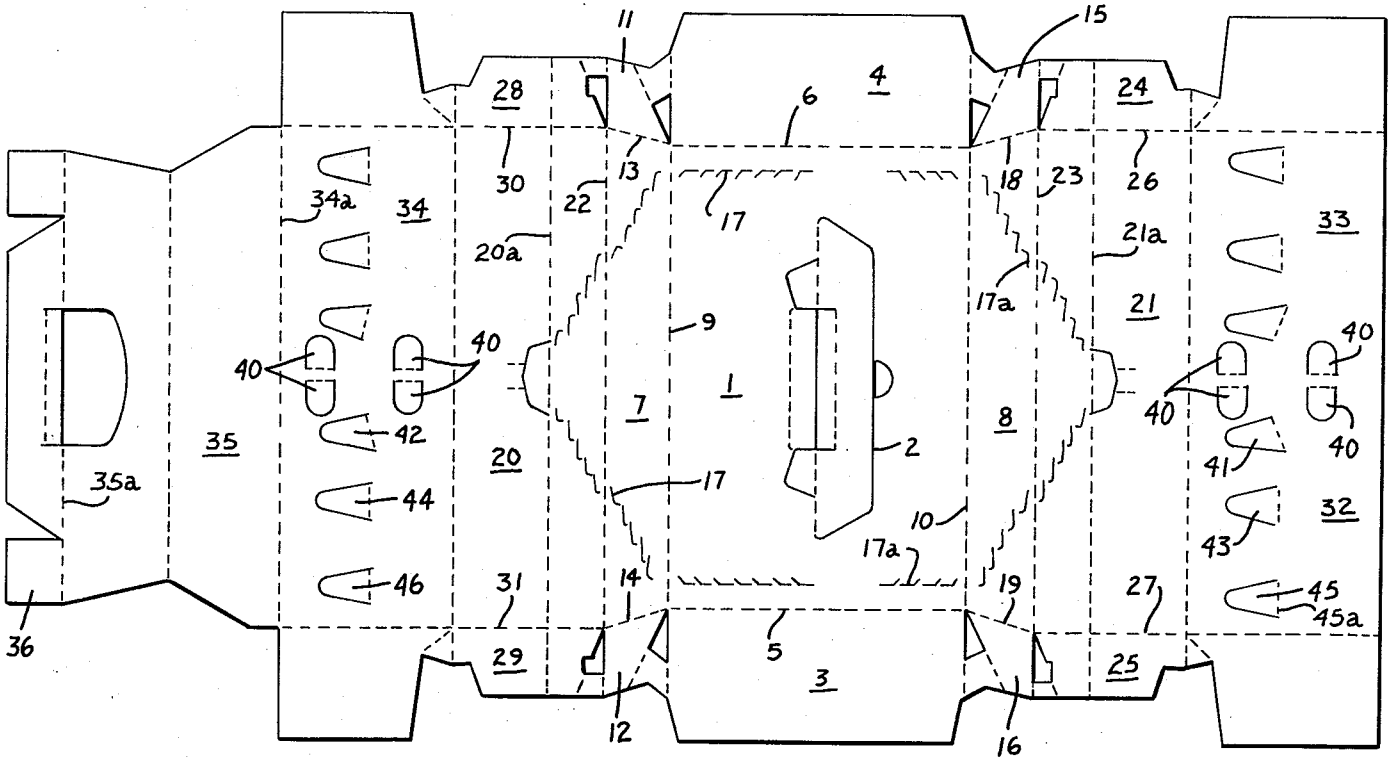
FIG. 1A is a plan view of a blank from which the container of FIG. 1 is formed.

The open ended sleeve type carton shown in FIG. 1 comprises a top wall 1 having hand gripping structure generally designated at 2. To the ends of top wall 1 end flaps 3 and 4 are foldably joined along fold lines 5 and 6. Top side wall panels 7 and 8 are foldably joined to top wall 1 along fold lines 9 and 10 and end flaps 11 and 12 are foldably joined to top side wall panel 7 along fold lines 13 and 14 respectively while top end flaps 15 and 16 are foldably joined to top side wall panel 8 along fold lines 18 and 19. Opening of the container is facilitated by tear lines 17 and 17*a*. Bottom side wall panels 20 and 21 are foldably joined to top side wall panels 7 and 8 along fold lines 22 and 23 respectively and bottom side wall end flaps 24 and 25 are foldably joined to bottom side wall panel 21 along fold lines 26 and 27 while bottom end flaps 28 and 29 are foldably joined to bottom side wall panel 20 along fold lines 30 and 31 respectively.

The bottom wall 32 is a composite panel including lap panels 33 and 34. Composite bottom end flaps are foldably joined to the ends of bottom wall 32. One such flap is designated in FIG. 1 at 32*a*. The opposite bottom end flap is not observable in FIG. 1. A medial partition 35 is foldably joined at its lower edge to the inner edge 34*a* of lap panel 34 and is secured to top wall panel 1 by a glue flap 36 which is foldably joined to panel 35 along fold line 35*a* and is secured to top wall 1 by suitable adhesive means.

The set up container as shown in FIG. 1 may be collapsed into flat condition by outward folding of side walls along fold lines 20*a* and 21*a*.

A plurality of centrally disposed article separating tabs are struck from bottom wall 32 and are designated by the numeral 40. A plurality of transversely arranged article separating tabs 41, 42, 43, 44, 45, and 46 are struck from bottom wall 32 and are foldably joined thereto along suitable score lines such as that indicated for example at 45*a* in connection with tab 45. Similar article separating tabs to tabs 41–46 are struck from the bottom wall at the other end of the container.

As is conventional practice, at stack of collapsed open ended sleeve cartons of the type shown in set-up open ended form in FIG. 1 are disposed in a hopper above the infeed end of a machine constructed according to the invention. Such structure for clarity and simplicity is not shown in the drawings.

Figure 2:
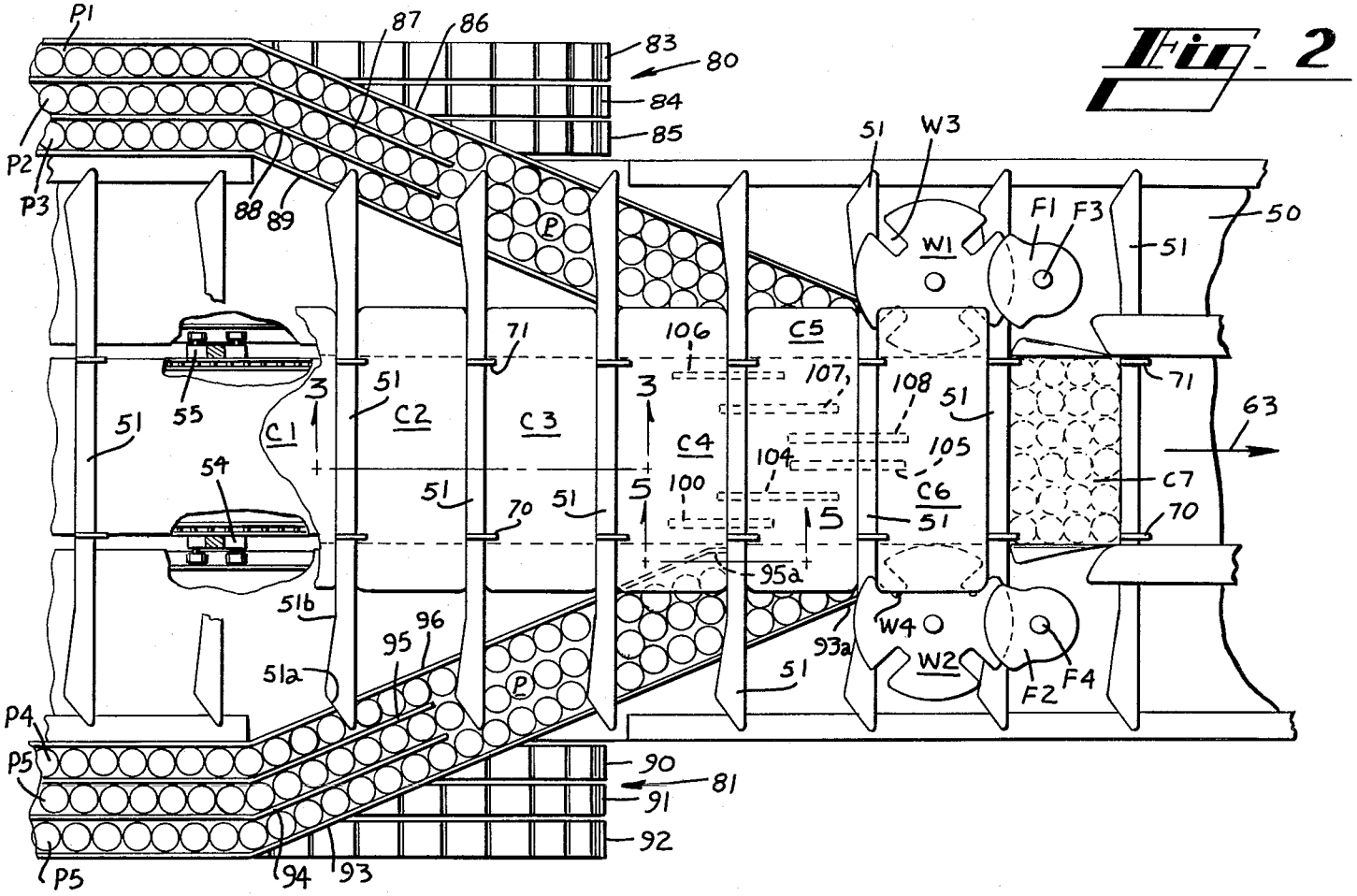
FIG. 2 is a schematic plan view of a machine constructed according to the invention.

With reference to FIG. 2, a fixed base plate is designated by the numeral 50 and is supported by the machine frame by structure not shown in the drawings. A plurality of spaced apart movable metering bars 51 are supported in spaced relation above the base plate 50 by support posts which extend through slots formed in the base plate 50. The slots are not observable in FIG. 2 because they are disposed underneath the cartons such as are designated at positions C1, C2, C3, C4, C5, C6, and C7 and the metering bars. The open ended sleeve type cartons such as C1–C7 are withdrawn from the hopper not shown and deposited between the metering bars 51 by known feeder means so that the containers then occupy the positions shown in FIG. 2 at C1–C7 between the horizontally disposed spaced apart metering bars 51.

Figure 3:
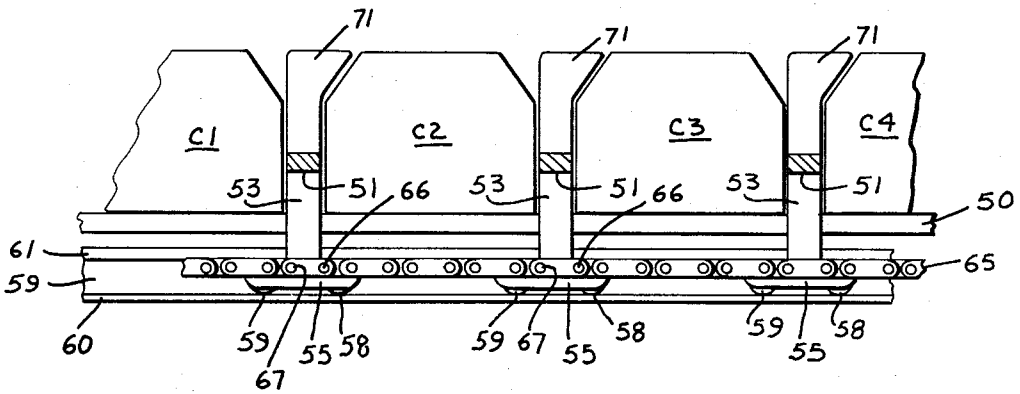
FIG. 3 is a sectional view taken along the line designated 3—3 in FIG. 2.
Figure 4:
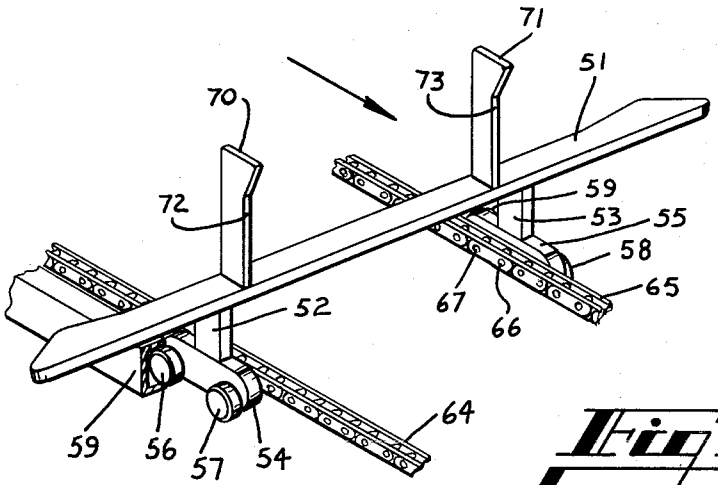
FIG. 4 is an isometric view with certain parts removed for clarity of the supporting structure for the metering bars.

Support for the metering bars is best shown in FIGS. 3 and 4 and includes support posts 52 and 53 which are mounted respectively on trucks 54 and 55. As is apparent from FIGS. 3 and 4, the support posts 52 and 53 are interconnected at their upper ends with a metering bar 51. Secured to one side of truck 54 is a pair of rollers 56 and 57. A pair of rollers such as are indicated at 58 are secured to truck 55. These rollers ride in tracks such as that indicated at 59 in FIG. 3. Track 59 is cross section is channel shaped so that the rollers such as 56 and 57 ride between the lower channel flange 60 and the upper channel flange 61. A similar channel is formed on the opposite side of the machine and receives the rollers 58 which support the truck 55. As explained, support posts 52 and 53 are slidably disposed within slots formed in base plate 50 which are not observable in FIG. 2 because they are disposed underneath various panels of the containers C1–C7 and the metering bars.

For the purpose of imparting movement from left to right as indicated by the arrow 63 in FIG. 1, a pair of endless elements 64 and 65 are interconnected by suitable means with the trucks 54 and 55. As is best shown in FIG. 4, truck 55 is interconnected with endless element such as chain 65 by means of pins 66 and 67.

The endless elements 64 and 65 are mounted in known manner on sprockets and are driven so that the upper working reaches of these endless elements move from left to right as viewed in FIG. 2 so that this movement of endless elements 64 and 65 causes the metering bars 51 to move from left to right as observed in FIG. 2. As is apparent from FIG. 3, the containers such as C1–C7 are interposed between the metering bars 51 and are slidably supported by the fixed base plate 50 which preferably is formed of low friction plastic material.

For the purpose of securing each of the containers in its normal set up condition, a pair of upstanding lugs 70 and 71 are secured atop each metering bar 51. The leading surfaces such as 72 and 73 of lugs 70 and 71 are shaped to conform with the configuration of the trailing side wall of the associated container. Movement from left to right of the metering bars as shown in FIG. 2 imparts movement from left to right of the open ended sleeve type containers C1–C7.

Primary packages to be loaded into each end of the containers C1–C7 are supplied to the machine on infeed conveyors generally designated by the numerals 80 and 81. In practice it has been found desirable to construct the conveyor 80 as a plurality of separate conveyors since the incoming packages are arranged in several rows. For example packages such as P1, P2 and P3 are supplied by individual conveyors 83, 84, and 85. This construction is convenient due to the fact that it allows the guide means such as are indicated at 86, 87, 88 and 89 to be mounted by structure which is interposed between conveyors 83 and 84 for example on the one hand and 84 and 85 on the other hand. Similarly rows of packages such as are designated at P4, P5, and P6 are supplied by a plurality of infeed conveyors 90, 91, and 92 and are guided inwardly at an acute angle toward the packaging machine by fixed guides 93, 94, 95, and 96.

Since the length of the measuring bars 51 is fixed and since the end portions of these bars are wedge shaped or bevelled as indicated at 51*a*, these bars serve as metering means for entrapping a predetermined number of primary packages between adjacent bars due to the fact that the guides 86–89 and 93–96 are directed at an acute angle inwardly toward the path of movement of the metering bars.

As is indicated at the end portions of the container designated at C3, the arrangement of the primary packages P is in the shape of a parallelogram. This parallelogram is maintained to facilitate entry of the bottles into the container. As the leading row of three bottles reaches the center line of the container, the lateral motion is arrested. Each succeeding row of three bottles ceases to move laterally inward when such row reaches the centerline of the container. Thus after this lateral movement of all rows of three bottles each is completed the bottle group describes a rectangle and thereby fills the space between adjacent metering bars. Since the dimension of a rectangle in the direction of movement of the metering bars 51 is greater than the corresponding dimension of a parallelogram, space must be provided to accomodate this difference. Thus in accordance with a feature of the invention, the metering bars 51 are cut away along their trailing edges as is indicated at 51*b* at the container position C1.

Figure 5:
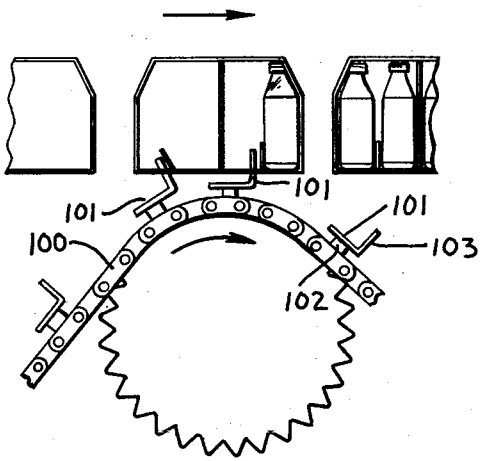
FIG. 5 is a cross-sectional view taken along the line designated 5—5 in FIG. 2.

It is obvious that the tabs 41–46 struck from the bottom wall 32 of the containers must be set up by suitable means prior to the time when the rows of bottles entrap these tabs. Thus it is necessary to provide means to effect this result. Each row of tabs such as 41, 42, and 43, 44 as well as 45, 46 is set up by structure such as that shown in FIG. 5 which includes a lug chain 100 on which a plurality of lugs such as 101 are mounted. Each lug has a base portion 102 and an angularly disposed upstanding portion 103 which physically engages the article separating tabs to effect a setting up operation as is indicated in FIG. 5. Lug chain 100 is driven by sprockets not shown but which are of conventional construction.

In FIG. 2 lug chain 100 is in a position to engage the container tabs before lug chain 104 and lug chain 104 engages the tabs before lug chain 105. A similar relationship exists with respect to the other side of the carton wherein lug chain 106 leads lug chain 107 which in turn leads lug chain 108 in sequence of operation. As is apparent from FIG. 2, these lug chains are set up in staggered relationship so that the outermost lug chains such as 100 and 106 effect tab setting up operations of tabs 45 and 46 prior to the setting up of the other tabs. Since the tabs are long, they must be set up before the bottles are inserted into the container. All of the tabs could be set up simultaneously and the bottles then could be inserted. Such a procedure is not preferred because it would result in a large upward force on the container bottom wall. Thus the sequential setting up of tabs so that the outer row such as 45, 46 is set up first followed by the intermediate row 43, 44 and finally the innermost row 41, 42. This sequence allows the innermost row of bottles to slide past the outer and intermediate rows of tabs and thence into position at the center of the container. The other two rows of bottles move into position in sequence.

Once the packages P are fully inserted in to the container by the portion such as 93*a* and 95*a* of the guide rails, they must be fully seated within the container and such action is effected by cloverleaf rotatable wheels such as W1 and W2 which engage the outermost bottles and move them completely into their final positions within the container. The slots such as W3 and W4 are provided for receiving the trailing end flaps of the side walls of containers such as C6 and the leading end flaps of the leading end wall of container C5. Structures W1 and W2 are well known in the art and do not constitute essential elements of this invention.

For the purpose of folding the trailing end flaps of the container such as C7 forwardly, rotatable folders F1 and F2 are provided and are rotatably mounted on their shafts F3 and F4 respectively. These folders are of known construction and do not constitute essential parts of this invention. The remaining flaps of the carton such as C7 are folded into closed position by suitable static guides of known construction. The end flaps may be secured by suitable adhesive or by suitable locking tabs as may be desired.

INDUSTRIAL APPLICABILITY

A packaging machine constructed according to this invention is well suited for use in conjunction with primary packages such as bottles used to package consumer items and is particularly well suited for loading open ended sleeve type containers which when fully completed as a package are fully enclosed and thus protect the contents from mechanical contact with foreign objects, from sunlight, and from other extraneous environmental agents.

We claim:

1. A machine for loading at least one row of primary packages (P) through each end of an open ended container sleeve (C), said machine comprising a horizontal fixed base plate (50) having infeed and outfeed ends, a plurality of transverse parallel metering bars (51) having wedge shaped ends and disposed above said base plate and spaced apart to receive transverse open ended sleeves therebetween and connected with endless means (64,65) having a working reach movable relative to said fixed base plate from a point adjacent the infeed end toward the outfeed end thereof and effective to move said sleeves, infeed conveyor means (80,81) disposed on each side of said base plate at the infeed end thereof, and fixed guide means (86–89) (93–96)disposed above said base plate on each side of the infeed end thereof and at an acute angle to the path of movement of said working reach of said endless means for receiving primary packages (P) from said infeed conveyor means respectively and for guiding said primary packages into the space between the wedge shaped ends of adjacent metering bars respectively and in turn into the open ends of said sleeves (C) respectively, said wedge shaped ends of said metering bars being effective to facilitate entry into said rows of primary packages moving in angular relation to the direction of movement of said metering bars to determine the number of primary packages which are loaded into each open end of the container.

2. A machine according to claim 1 wherein each group of primary packages is oriented in the general configuration of a parallelogram when disposed near the entry end of said base plate and wherein the trailing edge **(51*b*) of each of said metering bars is cutaway at each end thereof to provide adequate space for a group of primary packages (P) in the direction of movement along said working reach of said endless means (64,65)** as the trailing group of primary packages is reoriented from the configuration of a parallelogram to that of a rectangle in a horizontal plane.

3. A machine according to claim 1 wherein said working reach of said endless means (64,65) is disposed at a level below said fixed base plate (50).

4. A machine according to claim 3 wherein said metering bars (51) are mounted on support posts (52,53) supported by trucks (54,55) arranged to ride on fixed support rails (59) disposed at a level below said fixed base plate (50).

5. A machine according to claim 4 wherein said endless means (64,65) is interconnected with each of said trucks (54,55) to impart movement thereto.

6. A machine according to claim 4 wherein said base plate (50) is formed with a plurality of slots therein for slidably receiving said support posts (52,53) respectively.

7. A machine according to claim 1 wherein each of said metering bars (51) includes at least one upstanding lug (70,71) whose leading face (72,73) is configured to conform with the trailing side wall of the immediately preceding container (C).

8. A machine according to claim 1 wherein the bottom wall (32) of each container sleeve includes a plurality of package separating tabs (41–46) arranged in outermost, intermediate, and innermost transverse rows and struck from the bottom wall and foldably joined thereto and wherein a plurality of lug chains (100,104–108) each having tab folding lugs (101) thereon are respectively disposed below the path of movement of the containers for engaging the rows of tabs respectively so as to swing the tabs upwardly for disposition between adjacent packages in different rows.

9. A machine according to claim 8 wherein said lug chains are disposed in staggered relation to each other in the direction of movement of said metering bars so that the tabs in the outermost rows of tabs (100,106) are set up before the intermediate rows of tabs (104,107) and the intermediate rows of tabs are set up before the innermost rows of tabs (105,108).

* * * * *